US007045957B2

(12) United States Patent
Niigaki et al.

(10) Patent No.: US 7,045,957 B2
(45) Date of Patent: May 16, 2006

(54) POLYCRYSTAL DIAMOND THIN FILM AND PHOTOCATHODE AND ELECTRON TUBE USING THE SAME

(75) Inventors: Minoru Niigaki, Hamamatsu (JP); Shoichi Uchiyama, Hamamatsu (JP); Hirofumi Kan, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/223,378

(22) Filed: Aug. 20, 2002

(65) Prior Publication Data

US 2003/0001498 A1 Jan. 2, 2003

Related U.S. Application Data

(63) Continuation-in-part of application No. PCT/JP01/01287, filed on Feb. 22, 2001.

(30) Foreign Application Priority Data

Feb. 23, 2000 (JP) ..... P2000-046248

(51) Int. Cl.
*H01J 40/06* (2006.01)

(52) U.S. Cl. ..... 313/542; 313/544; 313/530

(58) Field of Classification Search ..... 313/310, 313/525, 528–530, 532, 539, 542–544; 219/121 EB
See application file for complete search history.

(56) References Cited

FOREIGN PATENT DOCUMENTS

| | | |
|---|---|---|
| EP | 0 752 293 A2 | 1/1997 |
| EP | 0 829 898 A1 | 3/1998 |
| JP | 02232106 | 9/1990 |
| JP | 9-67195 | 3/1997 |
| JP | 2000-149767 | 5/2000 |
| JP | 2001145828 | 5/2001 |

OTHER PUBLICATIONS

A. Laikhtman, et al., *Surface Quality and Composition Dependence of Absolute Quantum Photoyield of CVD Diamond Films*, Diamond and Related Materials, vol. 8, Mar. 1999, pp. 725-731.

*Primary Examiner*—Ashok Patel
(74) *Attorney, Agent, or Firm*—Drinker Biddle & Reath LLP

(57) ABSTRACT

In the polycrystal diamond thin film in accordance with the present invention, the average particle size is at least 1.5 μm and, in a Raman spectrum obtained by Raman spectroscopy, a peak intensity near a wave number of 1580 $cm^{-1}$ has a ratio of 0.2 or less with respect to a peak intensity near a wave number of 1335 $cm^{-1}$. The photocathode and electron tube in accordance with the present invention comprise the polycrystal diamond thin film as a light-absorbing layer.

9 Claims, 6 Drawing Sheets

POLYCRYSTAL DIAMOND THIN FILM AND PHOTOCATHODE AND ELECTRON TUBE USING THE SAME

RELATED APPLICATION

This is a continuation-in-part application of application Ser. No. PCT/JP01/01287 filed on Feb. 22, 2001, now pending.

BACKGROUND OF THE INVENTION

1. Field of the Invention

The present invention relates to a polycrystal diamond thin film which can absorb a predetermined wavelength of light and emit a photoelectron, and a photocathode and electron tube using the same.

2. Related Background Art

Photocathodes used for detecting a predetermined wavelength of light to be detected, and electron tubes equipped therewith have conventionally been known. A photocathode has a light-absorbing layer for absorbing a predetermined wavelength of light and emitting a photoelectron. The light to be detected is made incident on the light-absorbing layer and then is converted into a photoelectron, whereby it can be detected. While various semiconductor materials are used for the light-absorbing layer, Japanese Patent Application Laid-Open No. HEI 10-149761 discloses polycrystal diamond as a material having a high photoelectric conversion quantum efficiency with respect to ultraviolet light.

SUMMARY OF THE INVENTION

Along with higher integration of semiconductors in recent years, finer processing of semiconductor integrated circuits has been rapidly in progress. Currently, photolithography has been considered promising as a method of making a fine semiconductor integrated circuit, and studies have been under way in order to change light sources from ArF to those having a shorter wavelength such as $F_2$.

As such a technology utilizing ultraviolet light has advanced, photocathodes for monitoring ultraviolet light have been required to attain a further higher sensitivity.

Therefore, it is an object of the present invention to provide a polycrystal diamond thin film having a high photoelectric conversion quantum efficiency, and a photocathode and electron tube equipped therewith.

The inventors carried out diligent studies in order to improve the photoelectric conversion quantum efficiency of polycrystal diamond thin films and, as a result, have found that the photoelectric conversion quantum efficiency of a polycrystal diamond thin film is greatly influenced by its film quality.

As an index representing the crystallinity of diamond, a Raman spectrum obtained by Raman spectroscopy is used in general. FIG. 7 is a graph showing an example of Raman spectrum. In a Raman spectrum of polycrystal diamond, as can be seen from FIG. 7, a peak indicative of a diamond component occurs near a wave number of 1335 $cm^{-1}$, and a peak indicative of a non-diamond component occurs near a wave number of 1580 $cm^{-1}$. When the ratio between their respective peak intensities is calculated, the diamond component and non-diamond component (whose ratio will be referred to as "crystallinity" in the following) contained in the polycrystal diamond thin film can be evaluated quantitatively. Letting P1 be the peak intensity near a wave number of 1335 $cm^{-1}$, and P2 be the peak intensity near a wave number of 1580 $cm^{-1}$ in the Raman spectrum, P2/P1 is defined as "non-diamond ratio" indicative of the crystallinity in this specification.

The polycrystal diamond thin film in accordance with the present invention is characterized in that it has an average particle size of at least 1.5 μm; and that, in a Raman spectrum obtained by Raman spectroscopy, a peak intensity near a wave number of 1580 $cm^{-1}$ has a ratio of 0.2 or less with respect to a peak intensity near a wave number of 1335 $cm^{-1}$.

Thus, polycrystal diamond has a particle size of at least 1.5 μm, while the non-diamond ratio is set to 0.2 or less, whereby a polycrystal diamond thin film having a high photoelectric conversion quantum efficiency is realized.

The photocathode in accordance with the present invention is a photocathode comprising a light-absorbing layer for emitting an electron in response to the quantity of light incident thereon, the light-absorbing layer being made of polycrystal diamond or a material mainly composed of polycrystal diamond; wherein the polycrystal diamond has an average particle size of at least 1.5 μm; and wherein, in a Raman spectrum of the polycrystal diamond obtained by Raman spectroscopy, a peak intensity near a wave number of 1580 $cm^{-1}$ has a ratio of 0.2 or less with respect to a peak intensity near a wave number of 1335 $cm^{-1}$.

When polycrystal diamond having a particle size of at least 1.5 μm and a non-diamond ratio of 0.2 or less is employed as a main material for the light-absorbing layer of the photocathode, a photocathode having a favorable sensitivity can be realized.

The photocathode may be characterized in that the surface of the light-absorbing layer is terminated with hydrogen. When the surface of the light-absorbing layer is terminated with hydrogen as such, the light-absorbing layer surface can lower its work function, so as to emit photoelectrons more easily.

The photocathode may further comprise an activation layer, disposed on the surface of the light-absorbing layer, for lowering electron affinity. When the activation layer is disposed on the surface of the light-absorbing layer as such, the light-absorbing layer surface can lower its electron affinity, so as to emit photoelectrons more easily.

In the photocathode, the activation layer may comprise an alkali metal or an oxide or fluoride thereof. When the activation layer is constituted by such a material, the activation layer can be formed easily.

In the photocathode, the polycrystal diamond may have a conductivity of p-type. When the polycrystal diamond has a p-type conductivity, the polycrystal diamond can lower its resistance, so as to emit photoelectrons more easily.

The photocathode may further comprise a substrate for supporting the light-absorbing layer. When the photocathode comprises a substrate as such, the light-absorbing layer, which is a thin film likely to be damaged, can enhance its strength.

In the photocathode, the substrate may be transparent to light having a wavelength of 200 nm or less. When the substrate is transparent to light having a wavelength of 200 nm or less, the light entering from the substrate side can be detected.

The electron tube in accordance with the present invention comprises an entrance window transparent to a predetermined wavelength of incident light; the above-mentioned photocathode; an envelope accommodating the photocathode and supporting the entrance window; and an anode, accommodated in the envelope, for collecting a photoelectron emitted from the photocathode. Since the above-mentioned photocathode is used as a photoelectric converter, an electron tube having a favorable sensitivity can be realized.

DESCRIPTION OF THE PREFERRED EMBODIMENT

In the following, preferred embodiments of the electron tube in accordance with the present invention will be explained in detail with reference to the drawings. In the explanation of drawings, constituents identical to each other will be referred to with numerals identical to each other without repeating their overlapping descriptions.

Figure 1:
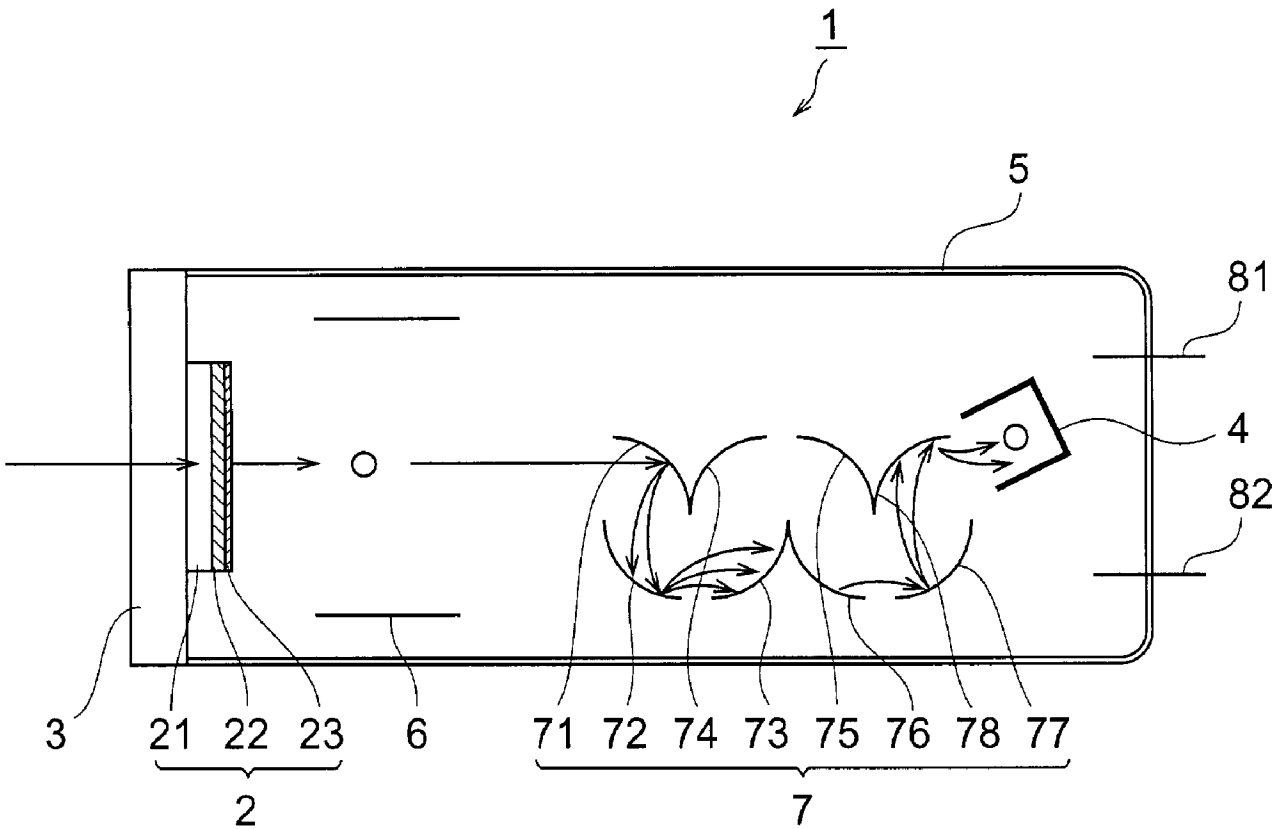
FIG. 1 is a view showing an electron tube in accordance with an embodiment of the present invention.

FIG. 1 is a view showing an electron tube 1 in accordance with an embodiment. The electron tube 1 comprises a photocathode 2 for absorbing a predetermined wavelength of light and emitting photoelectrons, an electron multiplier 7 for multiplying the emitted photoelectrons, an anode 4 for collecting the multiplied photoelectron, and an envelope 5 for accommodating these parts.

One end of the container 5 is provided with an entrance window 3 for introducing light to be detected into the envelope 5. The entrance window 3 is constituted by a material, such as $MF_2$, which is transparent to ultraviolet light which is light to be detected. The photocathode 2 is disposed near the entrance window 3; whereas the photocathode 2, the electron multiplier 7 constituted by a plurality of dynodes 71 to 78, and the anode 4 are disposed substantially parallel to the entrance optical axis of the light to be detected. The end part of container 5 on the side having the anode 4 is provided with stem pins 81, 82 for taking out the electrons collected by the anode 4 from within the envelope 5. Provided between the photocathode 2 and the electron multiplier 7 is a focusing electrode 6 for efficiently converging the photoelectrons emitted by the photocathode 2 onto the electron multiplier 7. The envelope 5 is evacuated so as to attain an ultrahigh vacuum of about $1\times10^{-10}$ Torr therein.

The photocathode 2 will now be explained. The photocathode 2 comprises a substrate 21 transparent to ultraviolet light which is light to be detected, a light-absorbing layer 22 made of polycrystal diamond disposed on the substrate 21, and an activation layer 23 disposed on the surface of the light-absorbing layer 22. The photocathode 2 is disposed within the envelope 5 such that the substrate 21 and the entrance window 3 oppose each other. Here, the substrate 21 and the entrance window 3 can be constructed as a single member from the same material.

Employed as the material for the substrate 21 is $CaF_2$, $MgF_2$, silica, sapphire, or the like which is transparent to ultraviolet light; whereas an alkali metal such as Cs, Rb, K, Na, or Li, or an oxide or fluoride thereof is used as the material for the activation layer 23.

The polycrystal diamond constituting the light-absorbing layer 22, which is a characteristic feature of this embodiment, will now be explained in detail. The polycrystal diamond has a conductivity of p-type, and is terminated with hydrogen in the vicinity of its boundary with respect to the activation layer. In terms of its film quality, crystals constituting the polycrystal diamond have an average particle size of at least 1.5 μm although their respective particle sizes are not constant, and a non-diamond ratio of 0.2 or less. The Raman spectrum employed as a basis for calculating this non-diamond ratio is one obtained by Raman spectral analysis using a laser light source having a spot diameter of 1 μm at a wavelength of 514.5 nm.

Figure 2:
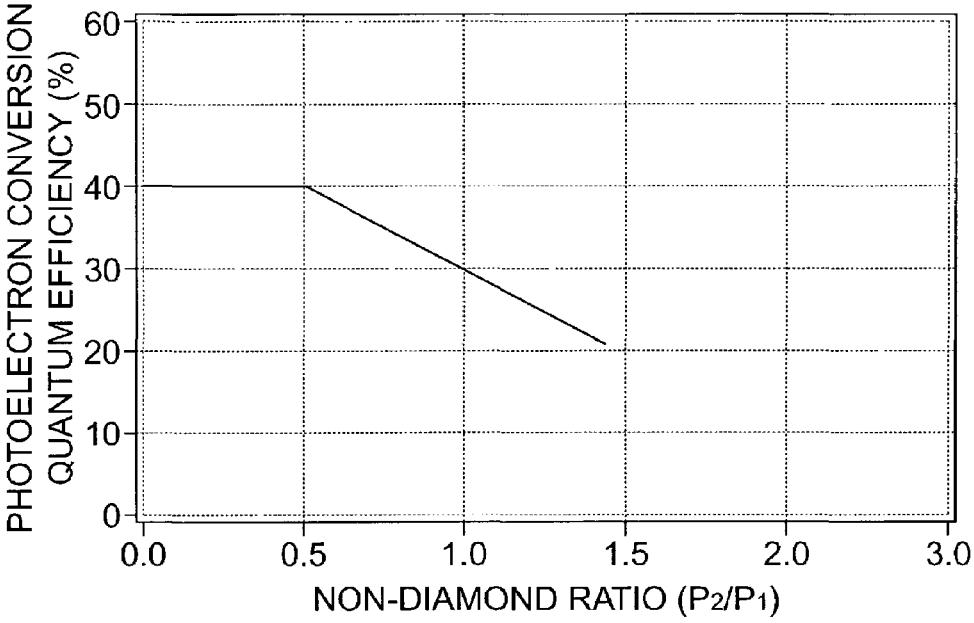
FIG. 2 is a graph showing the relationship between the non-diamond ratio and photoelectric conversion quantum efficiency of polycrystal diamond.
Figure 3:
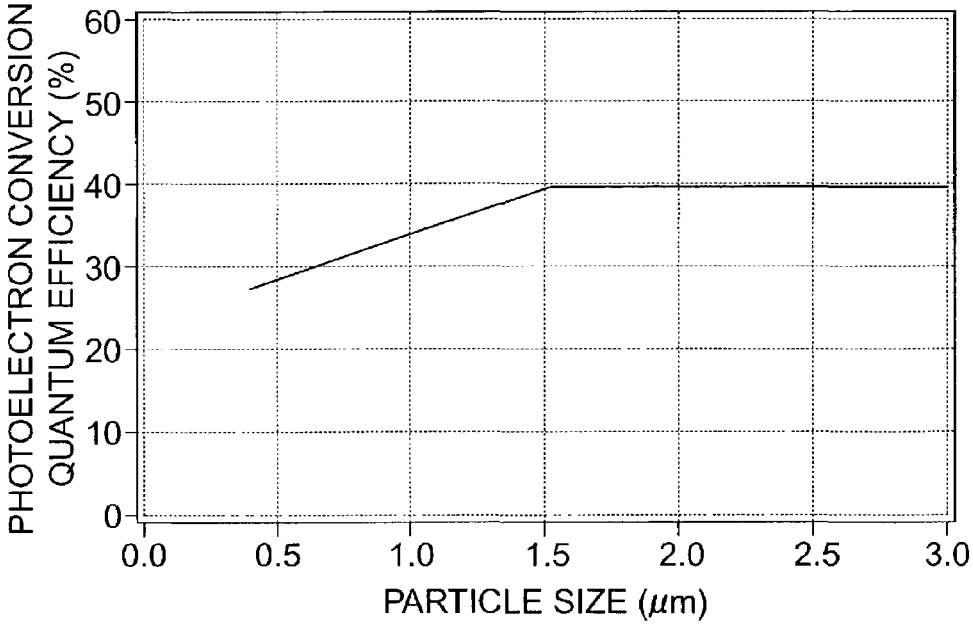
FIG. 3 is a graph showing the relationship between the particle size and photoelectric conversion quantum efficiency of polycrystal diamond.

The reason why it is preferable for the particle size and crystallinity of the polycrystal diamond used in the light-absorbing layer 22 of the photocathode 2 to satisfy the conditions mentioned above will now be explained with reference to FIGS. 2 and 3. FIG. 2 is a graph showing the relationship between the non-diamond ratio and photoelectric conversion quantum efficiency of the polycrystal diamond, whereas FIG. 3 is a graph showing the relationship between the particle size and photoelectric conversion quantum efficiency of the polycrystal diamond.

As shown in FIG. 2, the photoelectric conversion quantum efficiency increases as the non-diamond ratio decreases. However, the photoelectric conversion quantum efficiency does not exceed 40% even when the non-diamond ratio is lowered to 0.2 or less. On the other hand, as shown in FIG. 3, the photoelectric conversion quantum efficiency increases as the particle size of crystals becomes greater. However, the photoelectric conversion quantum efficiency also levels off at 40% in the range where the particle size is 1.5 μm or greater.

The inventors' studies have revealed that two parameters of non-diamond ratio and particle size are not independent from each other but influence each other. Namely, the photoelectric conversion quantum efficiency shown in FIG. 2 cannot be obtained in the polycrystal diamond whose particle size is smaller than 1.5 μm, even when its value of non-diamond ratio is lowered. On the other hand, the photoelectric conversion quantum efficiency shown in FIG. 3 cannot be obtained in the polycrystal diamond whose value of non-diamond ratio is greater than 0.2, even when its particle size is made greater than 1.5 μm. Hence, a high photoelectric conversion quantum efficiency of 40% can be obtained only in the polycrystal diamond in which both of parameters of crystallinity and particle size fall within the above-mentioned ranges.

The light-absorbing layer 22 of the polycrystal diamond having the above-mentioned crystallinity and particle size is manufactured as follows. The light-absorbing layer 22 is formed on the substrate 21 by a vapor growth method (CVD) using a microwave plasma while employing $CH_4$ and $H_2$ as reactant gases.

Figure 4:
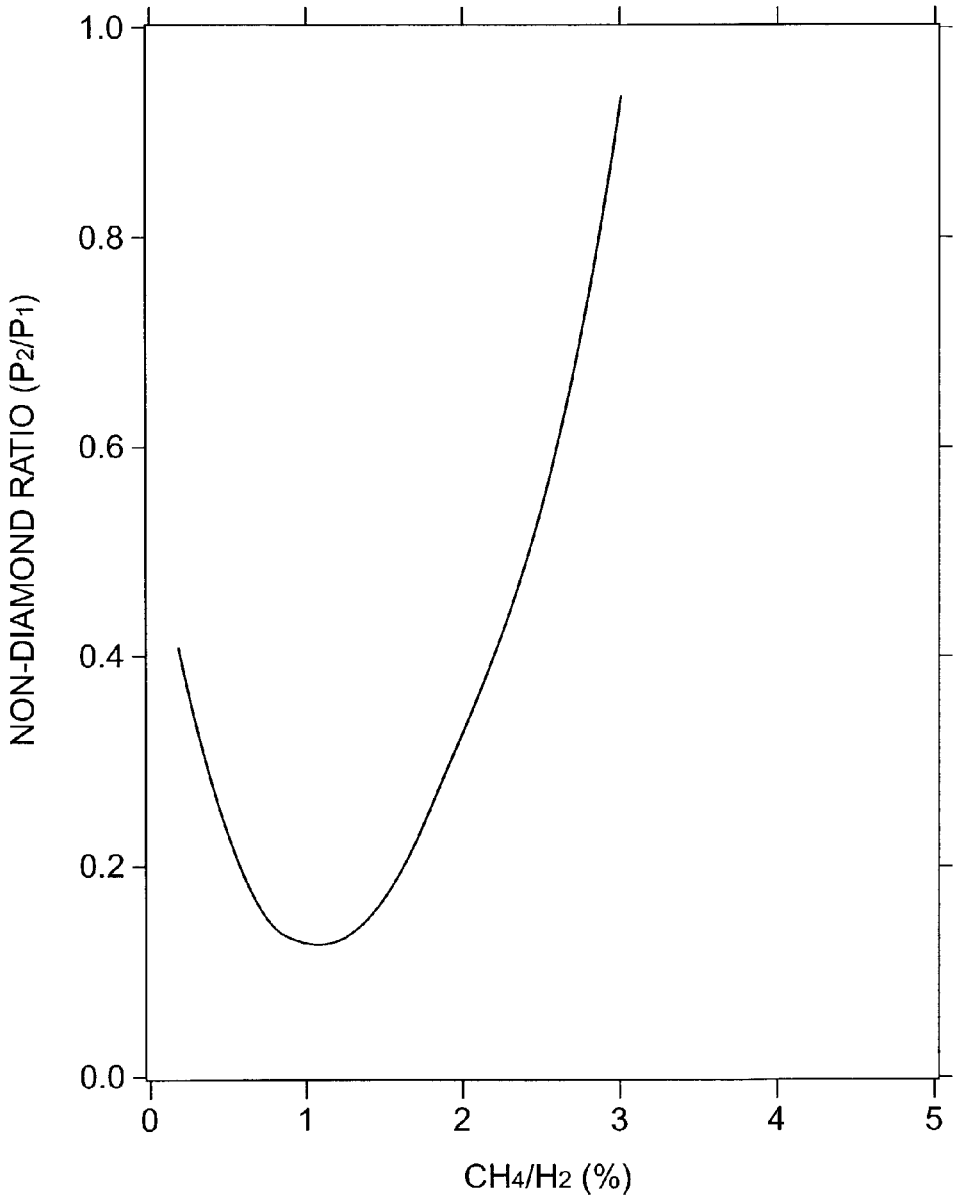
FIG. 4 is a graph showing the relationship between the ratio of $CH_4$ and $H_2$ contained in a vapor phase component and the non-diamond ratio of polycrystal diamond.
Figure 5:
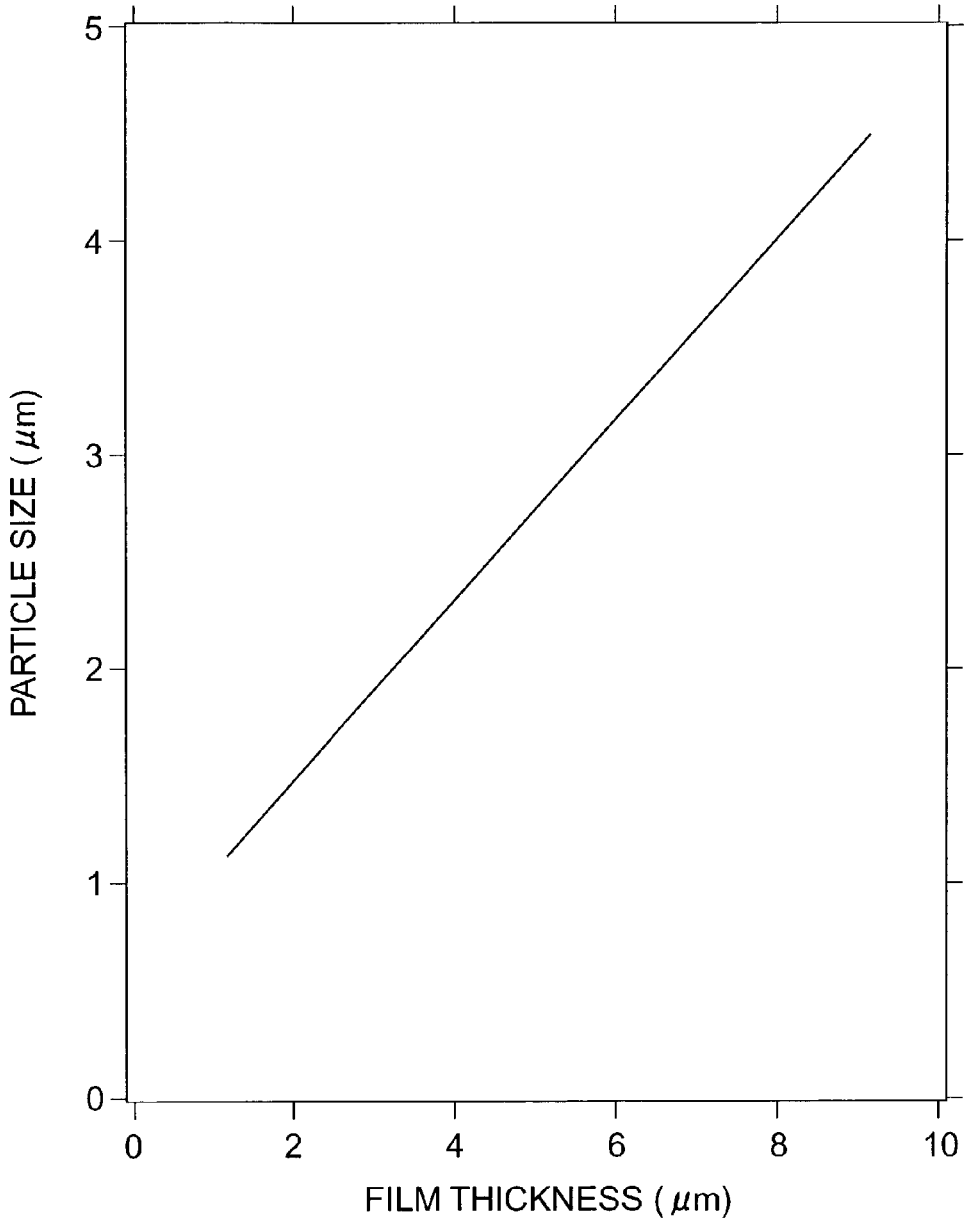
FIG. 5 is a graph showing the relationship between the thickness of a polycrystal diamond thin film and its particle size.

The crystallinity of polycrystal diamond can be controlled by the carbon component ratio in the vapor-phase component when carrying out the microwave plasma CVD, whereas its particle size can be controlled by the film thickness of polycrystal diamond formed thereby. FIG. 4 is a graph showing the relationship between the ratio of $CH_4$ and $H_2$ contained in the vapor-phase component and the non-diamond ratio of polycrystal diamond, whereas FIG. 5 is a graph showing the relationship between the thickness of the polycrystal diamond thin film and its particle size. As can be seen from FIG. 4, the non-diamond ratio is minimized when the value of $CH_4/H_2$ is near 1%, and becomes greater as the value of $CH_4/H_2$ increases. Also, as can be seen from FIG. 5, the film thickness of polycrystal diamond and its particle size are proportional to each other.

From these findings, it is seen that the polycrystal diamond can be controlled so as to have a particle size of at least 1.5 μm and a non-diamond ratio of 0.2 or less. For example, it will be sufficient if microwave plasma CVD is carried out in the vapor phase in which $CH_4$ and $H_2$ have a component ratio of $CH_4/H_2=0.01$, so that the polycrystal diamond grows until it attains a film thickness of about 3 μm.

The method of making the electron tube 1 in accordance with this embodiment and its action will now be explained briefly. The substrate 21 formed with the light-absorbing layer 22 made of polycrystal diamond is accommodated in the envelope 5 together with the electron multiplier 7, anode 4, and focusing electrode 6. Subsequently, the envelope 5 is connected to an exhaust system, by which a high vacuum of $1\times10^{-10}$ Torr is attained, and baking is carried out, so as to evacuate the impurities from within the envelope 5. Thereafter, test light is made incident on the photocathode 2, and the activation layer 23 is formed into a favorable thickness while monitoring the photoelectron emission current.

This electron tube 1 acts as follows. The light to be detected is transmitted through the entrance window 3 and enters the envelope 5. Thus entered light to be detected is fed into the photocathode 2, and the latter emits photoelectrons by an amount corresponding to the quantity of the light to be detected. Thus emitted photoelectrons are converged by the focusing electrode 6, so as to be fed into the electron multiplier 7. Then, electrons multiplied by the electron multiplier 7 are collected by the anode 4. The electrons collected by the anode 4 are taken out as a signal current from the envelope 5 by way of the stem pins 81, 82, which becomes a signal indicative of the light to be detected fed into the electron tube 1.

The photocathode 2 used in the electron tube 1 of this embodiment employs polycrystal diamond having a particle size of at least 1.5 μm and a non-diamond ratio of 0.2 or less as a material for the light-absorbing layer 22. This can realize the photocathode 2 in which the photoelectric conversion quantum efficiency is high, and can enhance the sensitivity of the electron tube 1.

The polycrystal diamond thin film acting as the light-absorbing layer 22 is formed by microwave plasma CVD using $CH_4$ and $H_2$ as reactant gases, and its surface is terminated with hydrogen. This can lower the work function of the surface of the light-absorbing layer 22, so that photoelectrons are emitted more easily, whereby the photoelectric conversion quantum efficiency can be improved.

Also, the photocathode 2 comprises the activation layer 23 on the surface of the light-absorbing layer 22. This can lower the electron affinity of the surface of the light-absorbing layer 22, thus making it easier to emit photoelectrons, thereby improving the photoelectric conversion quantum efficiency.

Further, the polycrystal diamond constituting the light-absorbing layer 22 has a conductivity of p-type. This can lower the resistance of the light-absorbing layer 22, so that the energy band in the vicinity of the surface is bent downward, by which photoelectrons can be emitted more easily, whereby the photoelectric conversion quantum efficiency can be improved.

This embodiment is also effective in that the light-absorbing layer 22 of the photocathode 2 having a high photoelectric conversion quantum efficiency can be formed efficiently.

Figure 6:
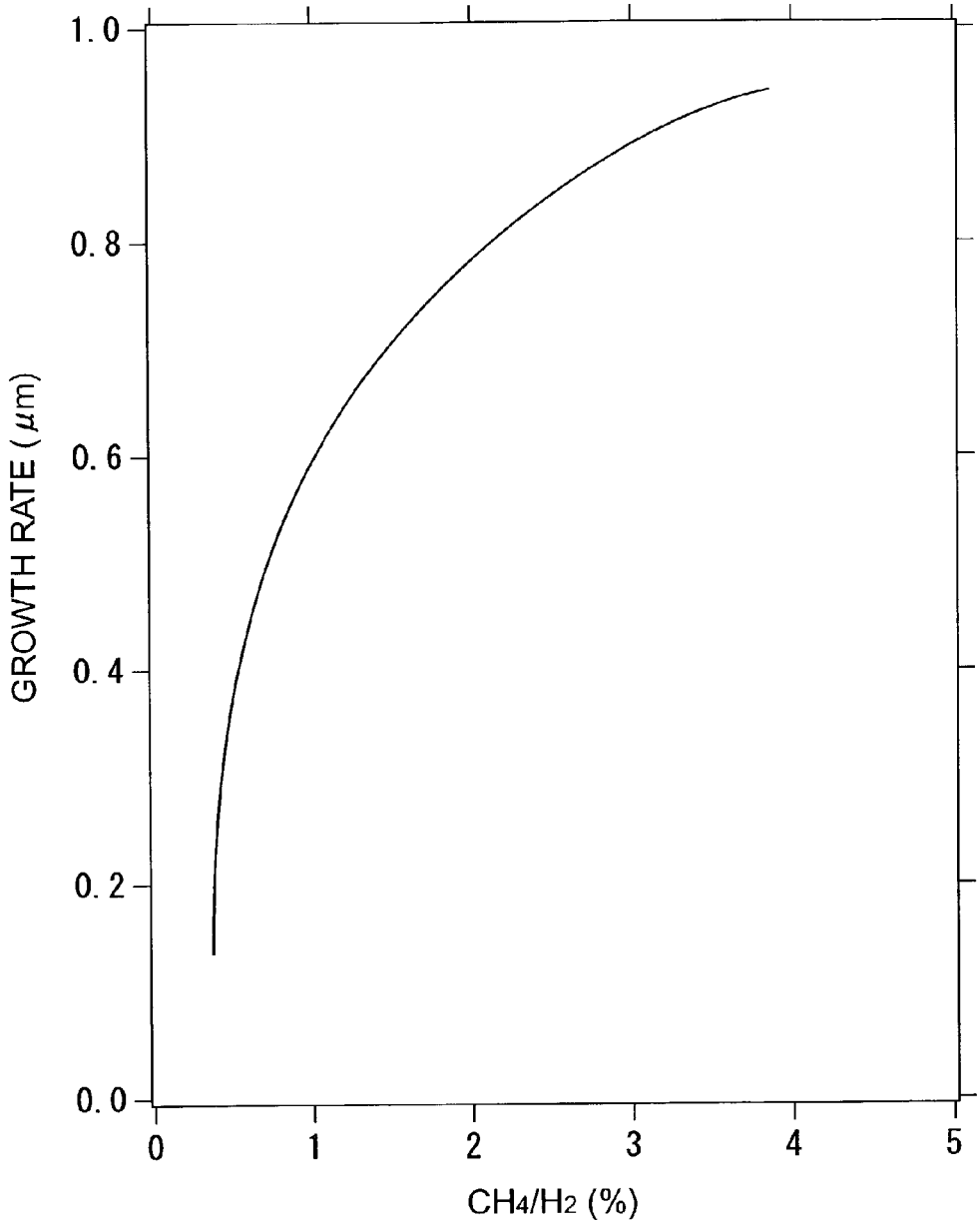
FIG. 6 is a graph showing the relationship between the ratio of $CH_4$ and $H_2$ contained in the vapor phase component and the growth rate of the polycrystal diamond thin film.
Figure 7:
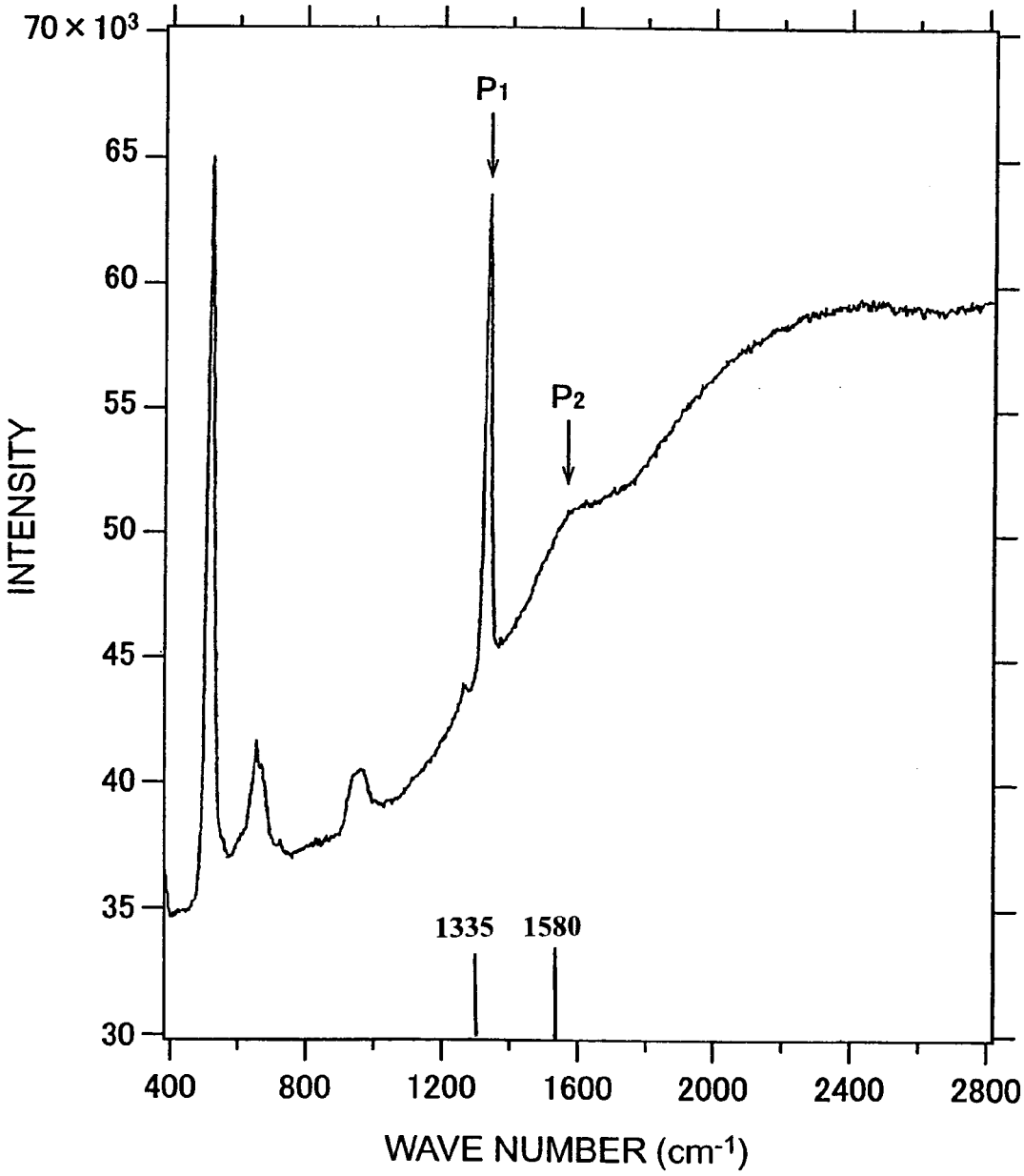
FIG. 7 is a graph showing an example of Raman spectrum.

It has conventionally been unknown which polycrystal diamond yields a high photoelectric conversion quantum efficiency. Therefore, even when it is empirically known that polycrystal diamond having a large particle size and a low non-diamond ratio is favorable, making such a polycrystal diamond thin film has been considered unfavorable in that it involves a high cost. Namely, as the ratio of $CH_4$ is raised in the case where polycrystal diamond is grown by microwave plasma CVD using $CH_4$ and $H_2$ as reactant gases, the polycrystal diamond deposits faster as shown in FIG. 6, but the non-diamond ratio becomes higher as shown in FIG. 4. Therefore, when simply based on the findings that the photoelectric conversion quantum efficiency increases if the non-diamond ratio is lowered while the particle size is made greater, polycrystal diamond must be grown for a long period of time by microwave plasma CVD in a vapor phase in which the ratio of $CH_4$ is low, which yields a low efficiency.

By contrast, the polycrystal diamond employed as the material for the light-absorbing layer 22 in this embodiment is defined in terms of particle size and crystallinity. Therefore, a vapor-phase component ratio at which the polycrystal diamond can be grown at the highest rate can be selected from vapor-phase component ratios (see FIG. 4) by which polycrystal diamond having a required non-diamond ratio (0.2 or less) can be formed. Also, the light-absorbing layer 22 thicker than the required film thickness (the thickness at which the particle size becomes 1.5 μm (see FIG. 5)) is kept from being formed, whereby the efficiency improves.

Though an embodiment of the present invention is explained in detail in the foregoing, the present invention is not restricted thereto.

Though the light-absorbing layer 22 is formed by use of a vapor growth method based on microwave plasma CVD in this embodiment, it may also be formed by hot filament CVD or the like. Combinations of CO and $H_2$, $CH_4$ and $CO_2$, and the like may also be used as the reactant gases without being limited to the combination of $CH_4$ and $H_2$.

Though this embodiment explains a transmission type electron tube 1 in which the light to be detected is made incident on the light-absorbing layer 22 by way of the substrate 21 whereas photoelectrons are emitted in the direction along which the light to be detected advances, it may be a reflection type electron tube in which the light to be detected enters from the activation layer side whereas photoelectrons are emitted in the direction opposite to the advancing direction of the light to be detected.

Further, the photocathode 2 of this embodiment is applicable not only to the electron tube 1, but also to various devices such as imaging tubes or display tubes equipped with a fluorescent substance, image intensifiers equipped with a microchannel plate and a fluorescent substance, electron bombardment tubes for accelerating electrons emitted from a photocathode and bombarding a solid-state device with thus accelerated electrons, and electron bombardment tubes for accelerating electrons emitted from a photocathode and bombarding a one- or two-dimensional position sensor device such as charge-coupled device.

The present invention can realize a polycrystal diamond thin film having a high photoelectric conversion quantum efficiency. Also, a photocathode and electron tube equipped therewith can realize a photocathode and electron tube having a high sensitivity.

Since the crystallinity and particle size of polycrystal diamond having a high photoelectric conversion quantum efficiency are defined, a polycrystal diamond thin film can be formed efficiently.

What is claimed is:

1. A photocathode comprising a light-absorbing layer for emitting an electron in response to the quantity of light incident thereon, said light-absorbing layer being made of polycrystal diamond or a material mainly composed of polycrystal diamond; wherein said polycrystal diamond has an average particle size of at least 1.5 μm; wherein, in a Raman spectrum of said polycrystal diamond obtained by Raman spectroscopy, a peak intensity near a wave number of 1580 $cm^{-1}$ has a ratio of 0.2 or less with respect to a peak intensity near a wave number of 1335 $cm^{-1}$; and wherein the Raman spectrum intensity exhibits an overall increasing trend as the wave number increases beginning at an intensity near a wave number of 1580 $cm^{-1}$.

2. A photocathode according to claim 1, further comprising:

a transparent substrate made of material selected from the group consisting of CaF2, $MgF^2$, silica, and sapphire; and an activation layer made of material including alkali metal, wherein said light-absorbing layer is arranged between said transparent substrate and said activation layer.

3. A photocathode according to claim 1, wherein said light-absorbing layer has a surface terminated with hydrogen.

4. A photocathode according to claim 1, further comprising an activation layer, disposed on a surface of said light-absorbing layer, for lowering electron affinity.

5. A photocathode according to claim 4, wherein said activation layer comprises an alkali metal or an oxide or fluoride thereof.

6. A photocathode according to claim 1, wherein said polycrystal diamond has a conductivity of p-type.

7. A photocathode according to claim 1, further comprising a substrate for supporting said light-absorbing layer.

8. A photocathode according to claim 7, wherein said substrate is transparent to light having a wavelength of 200 nm or less.

9. A electron tube comprising an entrance window transparent to a predetermined wavelength of incident light; the photocathode according to claim 7; an envelope accommodating said photocathode and supporting said entrance window; and an anode, accommodated in said envelope, for collecting a photoelectron emitted from said photocathode.

* * * * *